US011085192B2

(12) United States Patent
Mitchell

(10) Patent No.: US 11,085,192 B2
(45) Date of Patent: Aug. 10, 2021

(54) SCREEN ENCLOSURE SUPPORT ASSEMBLY

(71) Applicant: Danny P. Mitchell, Cape Coral, FL (US)

(72) Inventor: Danny P. Mitchell, Cape Coral, FL (US)

( * ) Notice: Subject to any disclaimer, the term of this patent is extended or adjusted under 35 U.S.C. 154(b) by 0 days.

(21) Appl. No.: 16/580,305

(22) Filed: Sep. 24, 2019

(65) Prior Publication Data

US 2020/0018073 A1 Jan. 16, 2020

Related U.S. Application Data

(60) Division of application No. 15/376,006, filed on Dec. 12, 2016, now Pat. No. 10,422,140, which is a continuation-in-part of application No. 29/580,043, filed on Oct. 5, 2016, now abandoned, which is a continuation-in-part of application No. 29/580,050, filed on Oct. 5, 2016, now abandoned, which is a continuation-in-part of application No. 29/580,059, filed on Oct. 5, 2016, now abandoned.

(51) Int. Cl.
*E04B 1/24* (2006.01)
*E04F 11/18* (2006.01)
*E04H 4/06* (2006.01)

(52) U.S. Cl.
CPC ..... *E04F 11/181* (2013.01); *E04H 4/06* (2013.01)

(58) Field of Classification Search
CPC ..... E04B 1/2403; E04B 2001/2415; E04B 2001/2454; E04C 2003/0465; E04C 2003/043; E04C 3/06
See application file for complete search history.

(56) References Cited

U.S. PATENT DOCUMENTS 3,382,639 A * 5/1968 Smith ..... E06B 9/52 52/844
6,385,941 B1 * 5/2002 Power, Jr. ..... E04C 3/06 160/392
6,601,362 B1 * 8/2003 Prince ..... E04C 3/06 52/844
6,826,885 B2 * 12/2004 Raskin ..... E04C 3/06 403/393
7,568,323 B2 * 8/2009 Shelton ..... E04C 3/06 52/579
7,877,962 B2 * 2/2011 Teffenhart, Jr. ..... E04C 3/06 52/273

(Continued)

*Primary Examiner* — Brian E Glessner
*Assistant Examiner* — Daniel J Kenny
(74) *Attorney, Agent, or Firm* — William E. Noonan

(57) ABSTRACT

A support assembly for a screen enclosure includes a collar device having a sleeve section with a central passageway for receiving an upright post of the enclosure and permitting the sleeve section to be adjustably positioned and fastened to the post. At least one channel is attached exteriorly to the sleeve section for receiving and being secured to a respective structural beam such that the beam is supported by and extends transversely to the upright post. The structural beam includes wide front and back face sections interconnected by narrow top and bottom side sections. At least one of the face sections has a spline groove formed longitudinally therethrough for receiving a screen panel and complementary spline component to secure the screen panel to the structural beam.

11 Claims, 9 Drawing Sheets

(56) References Cited

U.S. PATENT DOCUMENTS

| | | | | |
|---|---|---|---|---|
| 8,756,900 | B1 * | 6/2014 | Hudson | E04C 3/07 52/844 |
| D713,054 | S * | 9/2014 | Teffenhart, Jr. | D25/61 |
| 9,605,425 | B1 * | 3/2017 | Hendry | E04B 1/0046 |
| D830,545 | S * | 10/2018 | Loughren | D24/126 |
| 2007/0266671 | A1 * | 11/2007 | Chromy | E04C 3/06 52/844 |

* cited by examiner

SCREEN ENCLOSURE SUPPORT ASSEMBLY

RELATED APPLICATION

This application is a divisional application of U.S. application Ser. No. 15,376,006 filed Dec. 12, 2016.

FIELD OF THE INVENTION

This invention relates to a screen enclosure support assembly and, more particularly, to a beam support collar mounted on a vertical post of the enclosure and a horizontal beam carried by the collar for supporting a screen panel of the enclosure.

BACKGROUND OF THE INVENTION

Screen enclosures are commonly built above patios, lanais, porches, swimming pools, decks and other spaces. Such enclosures can be partially attached to a house or other building. Alternatively, the enclosure may comprise a gazebo, shelter or other free standing facility. Recently, the size and height of screen enclosures have increased dramatically. A growing number of these structures have been installed in conjunction with multi-story homes.

Virtually all conventional screen enclosures employ an extruded aluminum framework featuring vertical posts or columns and horizontal beams extending between the columns for supporting a number of screen panels. In most cases, the screen panels forming the sides of the enclosure are secured to both the upright posts set in the ground and the horizontal beams extending between the posts. In larger screen enclosures, such as those featured in multi-story homes, the screen panels form what is known as "picture windows" which can be quite expansive. Screen enclosures of this size may employ 2"×8" or even larger carrier beams to provide the framework and overall enclosure with adequate structural strength. Properly assembling and installing the framework of these large enclosures can be particularly challenging. Conventionally, receptacles must be precisely cut in the posts to accommodate the horizontal beams. This is tedious, time consuming and very labor intensive work. If accurate measurements are not carefully taken, the framework will not fit together correctly. The beams and posts may have to be re-cut and/or reassembled. Valuable time, material and expense may be wasted. When cuts are formed in the posts for receiving the beams, there is little, if any room for error or adjustment. A measuring mistake can result in the entire process having to be repeated. Inaccuracies and miscalculations are even more commonplace when inexperienced installers perform the work. Even if measurements and cuts are made accurately, the entire process of mounting the extruded beams to the posts of the enclosure tends to require an inordinate amount of time and effort. This translates to increased construction costs.

The particular horizontal beams presently utilized to form picture windows in larger screen enclosures exhibit additional disadvantages. These oversized extruded beams, which may be 2"×8", 2"×9" or 2"×10" in size, normally comprise two opposing extruded half pieces, each of which includes a wide or broad surface forming a respective face of the beam and a pair of relatively narrow legs extending perpendicularly from the wide surface. When the two half pieces are joined together, the opposing pairs of legs overlap and interconnect to form top and bottom sides of the finished beam. Conventionally, spline grooves are formed in the narrow legs and thereby in the top and bottom sides of the beams. These grooves receive elastomeric splines to attach the screen panels to the beams. The spline grooves have heretofore been formed in the top and bottom sides because the pieces used to form the beams have also traditionally been utilized for forming roof rafters and vertical uprights. However, that placement of the grooves is problematic when the beams are used to support the "picture window" screen panels that define the sides of the larger enclosures. In order to properly support the screen panels in such structures, the spline grooves should ideally be formed in the broad, outwardly facing vertical surface of the assembled beam rather than the narrow upper and lower side surfaces. Otherwise, the screen is apt to be too easily dislodged from the beam by high winds or other adverse weather conditions.

In an attempt to overcome the foregoing problem, screen enclosure installers have previously added an extruded L-shaped 1"×2" attachment piece to the narrow top side of the assembled beam. The 2" leg of the attachment is engaged with the 2" side surface of the beam. The 1" leg section of the attachment overlaps the wide outer face of the assembled beam and includes a spline groove that is thereby effectively formed on the preferred outer face of the beam. However, even this attempted solution has not proven to be optimally effective. For one thing, adding such an attachment to each of the horizontal beams of a large enclosure requires the expenditure of considerable time, labor and expense, which increases the cost of installing the screen enclosure considerably. In addition, the spline groove attachment itself is apt to be torn from the horizontal beam by high winds of the type that are frequently encountered in tropical locations where large or oversized screen enclosures are often installed. This can cause serious damage to the enclosure, which may be expensive and time consuming to repair.

SUMMARY OF THE INVENTION

It is therefore an object of the present invention to provide an improved screen enclosure support assembly employing extruded components that facilitate the construction of a screen enclosure or similar structure and which considerably reduce the time, labor and expense normally associated with building such structures.

It is a further object of this invention to provide a collar device for more quickly, conveniently and precisely mounting a structural beam to an upright support post or column.

It is a further object of this invention to provide a structural beam support collar that is readily adjustable along an upright post and which may be secured to the post without the need for precisely measuring and cutting a beam-accommodating receptacle into the post.

It is a further object of this invention to provide a structural beam support collar that reduces the delays and costs that commonly result from inaccurate or imprecise attachment of the beam to an upright post and which enables structural beams to be more quickly and easily installed, even by inexperienced or less skilled installers.

It is a further object of this invention to provide a structural beam support collar that reduces the waste of material and the time, labor and expense that are often involved in repairing mistakes that are made when securing a horizontal beam to an upright post in a screen enclosure or similar device.

It is a further object of this invention to provide a structural support beam for a screen enclosure or analogous structure that includes a spline grooved formed in a wide face of the beam and which thereby provides for secure and dependable support of a screen panel in an oversized or large screen enclosure or similar structure.

It is a further object of this invention to provide a structure that allows a large extruded beam to be more conveniently and efficiently constructed with a spline groove formed in a broad face of the beam rather than along a top or bottom edge of the beam and which further allows the beam to be constructed without the use of extra extruded attachments that add to the cost of construction and that are subject to being dislodged by high winds.

This invention features a collar device for mounting at least one structural beam to an upright post. The collar device includes a sleeve section having a central passageway formed therethrough for receiving, the upright post and permitting the sleeve section to be adjustably positioned along the post. The sleeve section is fastened at a selected position on the post. The collar further includes at least one beam accommodating channel attached exteriorly to the sleeve section. Each channel receives and is secured to an end of a respective structural beam such that the bear is supported by and extends transversely to the upright post.

In a preferred embodiment, the sleeve has a shape for conforming to the shape of the upright post when the sleeve is engaged with the post. More particularly, the sleeve section may have a rectangular cross sectional shape with four exterior side walls and each channel may include a pair of spaced apart flanges attached to and extending outwardly from a respective exterior side wall of the sleeve section. A respective structural beam is inserted between and secured to the spaced apart flanges to mount that beam to the upright post.

In certain versions, first and second channels may be attached exteriorly to respective side walls of the sleeve section. In other versions, only a single channel may be carried by the sleeve section. When a pair of channels are employed, these may be attached to opposing exterior side walls of the sleeve section such that respective structural beams received by and secured to the opposing channels are substantially aligned with one another. Alternatively, a pair of channels may be attached to adjacent exterior side walls of the sleeve section such that respective structural beams received by and secured to those channels are perpendicular to one another. A first flange in the spaced apart pair of flanges may be coplanar with and an extension of an associated one of the exterior side walls of the sleeve section. The sleeve section may include multiple discrete segments that are spatially adjustable relative to one another such that the sleeve segments are spatially adjustable relative to one another. This allows the side of the passageway to be adjusted to conformably accommodate upright posts having various sizes.

This invention also features a structural beam assembly for supporting a screen panel in a screen enclosure. The beam assembly comprises first and second beam pieces. Each beam piece includes an elongate, relatively wide face section and a pair of elongate, relatively narrow leg sections attached to and extending laterally from respective opposite longitudinal edges of the face section. Respective pairs of leg sections of the first and second beam pieces are interengaged and interconnected to form a box beam wherein the relatively wide face sections of the first and second beam pieces respectively oppose and are generally parallel to one another. At least one of the relatively wide face sections has a spline groove formed longitudinally therethrough on an exterior surface of the face section and proximate longitudinal edge thereof. The spline groove receives the screen panel and a complementary spline component to secure the screen panel to the beam assembly.

Preferably, the first leg section of each beam piece interengages and interconnects to the second leg section of the other beam piece to form the box beam. The leg sections of the first beam piece and the leg sections of the second beam piece may include complementary self-mating surfaces that interconnect the first and second beam pieces when the respective leg sections are interengaged. Each beam piece may include a first leg section that has an interior rib formed on an inside surface thereof proximate the face section. Each beam piece may further include a second leg section that has an exterior rib formed on an outside surface thereof proximate the face section. When the respective pairs of leg sections are interengaged and interconnected, the first and second leg sections of the first beam piece may interengage the exterior and interior ribs respectively of the second beam piece and the first and second leg sections of the second beam piece may interengage the exterior and interior ribs respectively of the first beam piece. The first and second leg sections may include respective self-mating surfaces, which face the same direction such that interengaging the first and second leg sections of the first beam piece with the second and first leg sections respectively of the second beam piece attaches the first and second beam pieces together. The self-mating surfaces may include gripping teeth that cooperate when the respective leg sections of the first and second beam pieces are interengaged to secure the first beam piece to the second piece and form the beam assembly.

This invention also features a support assembly for a screen enclosure featuring a collar device and a structural beam assembly as set forth above.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
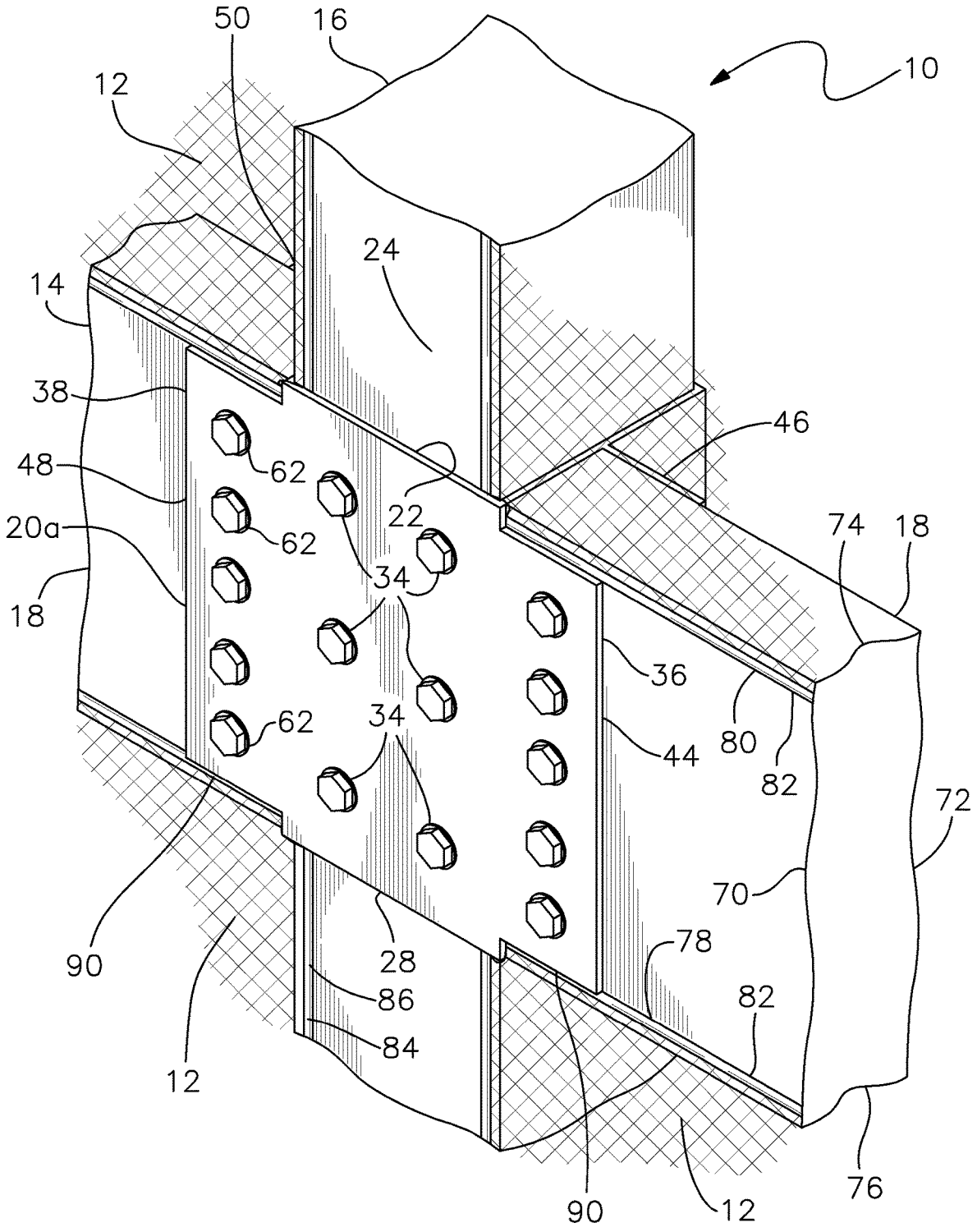
FIG. 1 is a perspective fragmentary view of a screen enclosure support assembly employing a carrier beam assembly and a 180° beam support collar in accordance with this invention.

There is shown in FIG. 1 a screen enclosure support assembly 10 that is specifically suited for use in the supportive frame of a screen enclosure. For illustrative purposes, FIG. 1 discloses only a representative fragmentary portion of the entire screen enclosure, which illustrates the structure and operating principles of support assembly 10. It should be understood that analogous features, as disclosed herein, are utilized in other support assemblies incorporated within the screen enclosure. The support assembly is particularly beneficial for use in supporting screen panels 12 or "picture windows" used in multiple story or other large screen enclosures. In FIG. 1 screen panels 12 are supported by an extruded aluminum framework 14 comprising a plurality of upright or vertical columns or posts 16 mounted in the ground or to an underlying deck. Framework 14 also features horizontal carrier beams 18 that are mounted between adjacent posts 16. For purposes of clarity and illustration, FIG. 1 shows only a portion of a single post 16 as well as pertinent end portions of a pair of aligned carrier beams 18 attached to post 16. It should be understood that a number of additional posts and beams are typically used to define the perimeter of the enclosure. In addition, multiple beams are typically mounted to extend horizontally between adjoining posts at one or more selected height levels of the enclosure. Framework 14 may also include traditional roof rafters and purlins, which are not shown herein. Each of these components is typically composed of extruded aluminum or other material suitable for use in screen enclosures. Screen panels 12 are typically mounted between the various posts, beams purlins and rafters such that the screen extends across and is supported by the framework 14 of the screen enclosure. In particular, the screen panels are secured by elastomeric splines that are inserted into spline grooves formed in the extruded components of framework 14. The broad technique of using splines to attach the screen panels to the framework of a screen enclosure is conventional. The present invention specifically relates to support collars for effectively mounting the carrier beams to the upright posts, as well as to a previously unavailable carrier beam construction which uniquely positions the spline grooves and screen fastening splines in the broad or wide face of the beam, in the manner described below, so that the screen is more effectively secured to the framework, particularly in oversized or large screen enclosures. Although support assembly 10 is especially beneficial for use in screen enclosures, wherein the framework comprises extruded aluminum, the support assembly may also be used in other types of buildings and structures within the scope of this invention.

Figure 2:
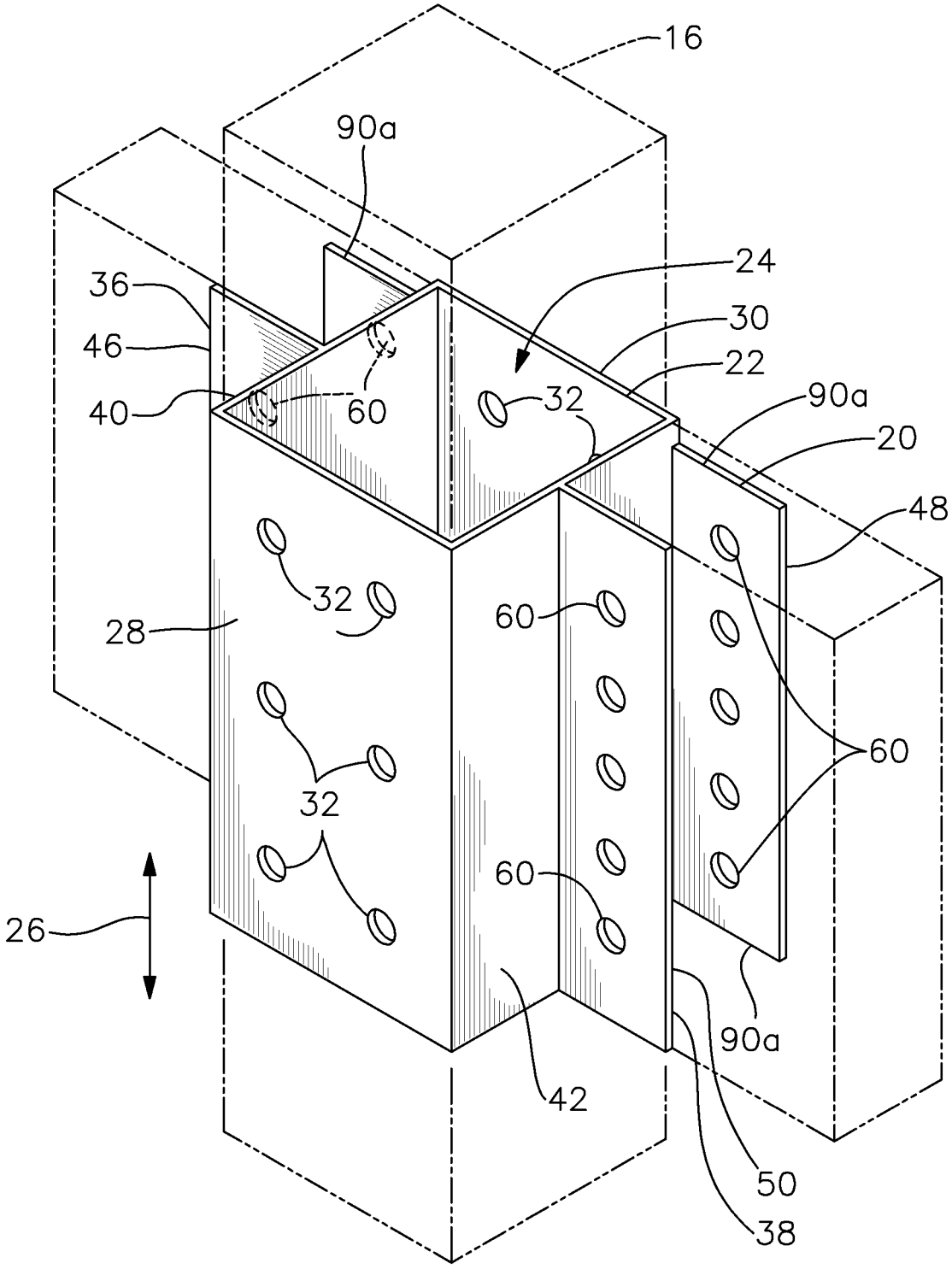
FIG. 2 is a perspective view of the 180° beam support collar featuring aligned channels for supporting respective carrier beams.
Figure 3:
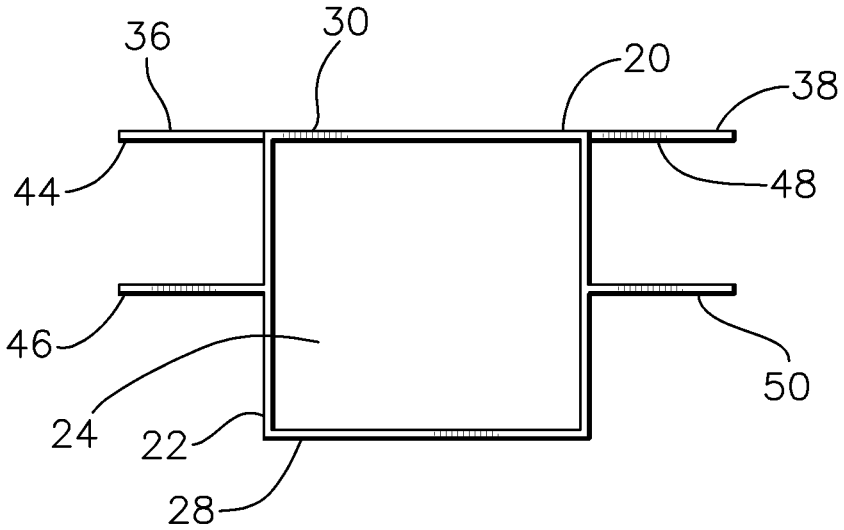
FIG. 3 is a top end view of the support collar of FIGS. 1 and 2.
Figure 4:
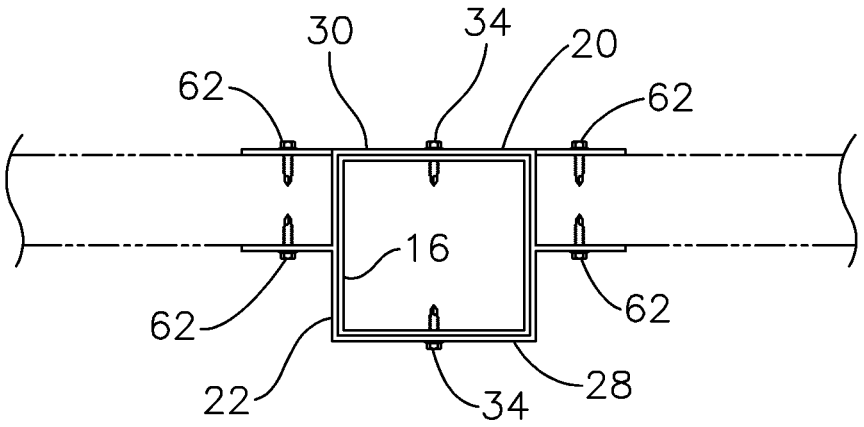
FIG. 4 is a top end view of the collar of FIGS. 1-3 mounted on an upright vertical post and supporting a pair of aligned carrier beams.

Carrier beams 18 are specifically mounted to upright posts 16 in an aligned fashion by a 180° beam support collar 20, which is further shown in FIGS. 2-4. Collar 20 is composed of a strong and durable extruded metal such as aluminum or an alternative alloy suitable for use in constructing screen enclosures and analogous structures. The collar includes a sleeve section 22, which has a central passageway 24 that extends from top to bottom therethrough. Collar 22 has a rectangular cross sectional shape for conformably receiving a corresponding upright post 16 through passageway 24. In the version shown in FIGS. 1-4, collar sleeve 22 specifically features a square cross sectional shape for conformably engaging a square post 16. Sleeve 22 may have alternative rectangular and other cross sectional configurations that conform to the shape of the post on which the collar is to be mounted. Sleeve 22 and passageway 24 may feature various dimensions and sizes within the scope of this invention.

As will be described more fully below, collar 20 is slidable longitudinally along upright post 16 in the manner indicated by double headed arrow 26 in FIG. 2. This enables collar 20 to be properly positioned along post 16 so that the collar may be mounted and secured at a required height for supporting one or more carrier beams. As shown in FIG. 2, inner and outer walls 28 and 30, respectively, of sleeve 22 include a series of fastening holes 32. In particular, six fastening holes 32 are formed through inwardly facing wall 28 and a like number of fastening holes are formed through outwardly facing wall 30. Only two of the fastening holes in wall 30 are apparent due to the perspective of sleeve 22 shown in that view. These holes are engaged by fastening screws or bolts 34 (e.g. TEK screws), FIG. 1, which secure sleeve 22 and collar 20 to post 16 at a selected height. It should be understood that other numbers and arrangements of fasteners and fastening holes may be used to attach the collar to the post. For example, in FIG. 4, only a single column of fasteners 34 and corresponding fastening holes are employed.

Collar 20 also features an opposing pair of beam accommodating channels 36 and 38, which are attached exteriorly to respective side walls 40 and 42 of sleeve 22. Channel 36 includes a pair of spaced apart flanges 44 and 46 that are extruded unitarily with and extend outwardly from side wall 40 of sleeve 22. Analogously, channel 38 includes a pair of spaced apart flanges 48 and 50 that are extruded or otherwise formed unitarily with side wall 42 of collar sleeve 22. Flange 44 of channel 36 and flange 48 of opposing channel 38 are coplanar with and essentially extensions of outwardly facing wall 30 of sleeve 22. Each pair of spaced apart flanges are substantially parallel to one another. In alternative embodiments, the connectors may be formed separately from the sleeve and welded or otherwise fastened thereto. Nonetheless, a one-piece extruded construction is preferred. Each channel 36 and 38 receives one end of a respective beam 18 in the manner shown in FIGS. 1, 2 and 4. The opposite end of the beam is typically supported by the channel of another collar, not shown, which is mounted to an adjoining post according to this invention. The spacing between the channels may vary within the scope of this invention such that the channels are capable of accommodating beams having an assortment of thicknesses.

As shown in FIG. 1, each beam 18 includes relatively wide front and back faces 70 and 72 respectively, as well as top and bottom sides 74 and 76, respectively. The preferred assembly of the beam, in accordance with this invention, is described more fully below.

To secure beams 18 to collar 20, each of channels 36 and 38 is provided with a series of fastening holes 60, which are formed through the flanges 44, 46 and 48, 50 of connectors 36 and 38 respectively. Various numbers of fastening holes may be formed. For example, in FIG. 2, each flange is provided with a series of five fastening holes. The perspective view of FIG. 2 shows only the top fastening holes in flanges 44 and 46. Each connector 36 and 38 receives one end of a respective beam 18 in the manner shown in FIGS. 1, 2 and 4. Fastening screws 62, FIGS. 1 and 4, which may be identical to previously described fastening screws 34, are interconnected to the accommodated beams 18 through fastening holes 60 in channels 36 and 38. The fastening screws 62 are typically fastened to the broad or wide outer face 70 of beam 18. In other versions, the collar may be reversed and flanges 36 and 38 may be secured to the wide inner faces 72 of respective beams 18. As a result, each beam 18 is fastened securely to a respective channel and in turn to collar 20, as well as to the post 16 to which the collar is mounted. The opposite end of each beam 18 is secured in an analogous manner to the adjacent post of the screen enclosure.

Critically, at least one of the inner and outer faces, and as shown in FIG. 1 outer face 70 particularly includes one or more longitudinal spline grooves 80 for holding an elastomeric screen spline elements 82. This construction serves to secure respective edges of screen panels 12 in place along the various extruded components of the screen enclosure. Fastening screen panels to extruded elements of an enclosure is well known in the prior art. Nonetheless, the formation of spline grooves and fastening splines in the broad or wide front and back faces of the carrier beam has not heretofore been practiced. The manner of accomplishing this novel structural feature is described more fully below. It should further be understood that, as shown in FIG. 1, spline grooves 84 and corresponding spline elements 86 may also be formed in a conventional manner in the upright post 16 for securing vertical edges of the screen panels thereto.

As also shown in FIG. 1, collar 22*a* may be optionally modified or cut in a manner that exposes the entire spline groove 80 and supported spline element 82 in the broad front or outer face 70 of beam 18. Therein, flanges 44 and 48 are cut along the top and bottom edges thereof to form notches 90 that expose the spline grooves 78 and 80 and spline elements 82 for the entire length of the beam, including the inner ends of the beams accommodated within the respective connectors 36 and 38 of collar 20. This exposure allows the screen panel to be more effectively secured along its entire upper and/or lower edges all the way to the inner end of each beam supported by collar 20. As shown in FIG. 2, alternative versions of collar 20 may either lack notched flanges or include notches 90 as depicted in phantom.

Figure 5:
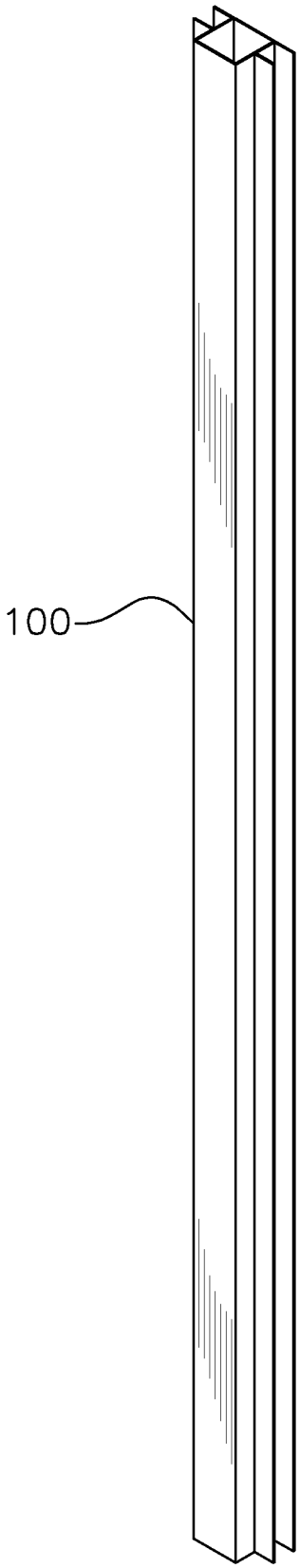
FIG. 5 is a perspective view of an elongate piece of extruded aluminum from which a number of 180° collars in accordance with FIGS. 1-4 may be cut.

FIG. 5 depicts an elongate extruded component 100 that features the profile or cross sectional configuration of collar 20 shown in FIGS. 1-4. Typically, component 100 may be extruded in 12' lengths for delivery to an installer and/or installation site. At the site, or at a shop, the 12' extruded pieces may be cut transversely in one or more selected lengths for accommodating beams of differing widths (e.g. "8, 9", 10"). It should be understood that the top to bottom length of the sleeve and collar as well as the spacing between the flanges of the connectors maybe varied within the scope of this invention.

Figure 6:
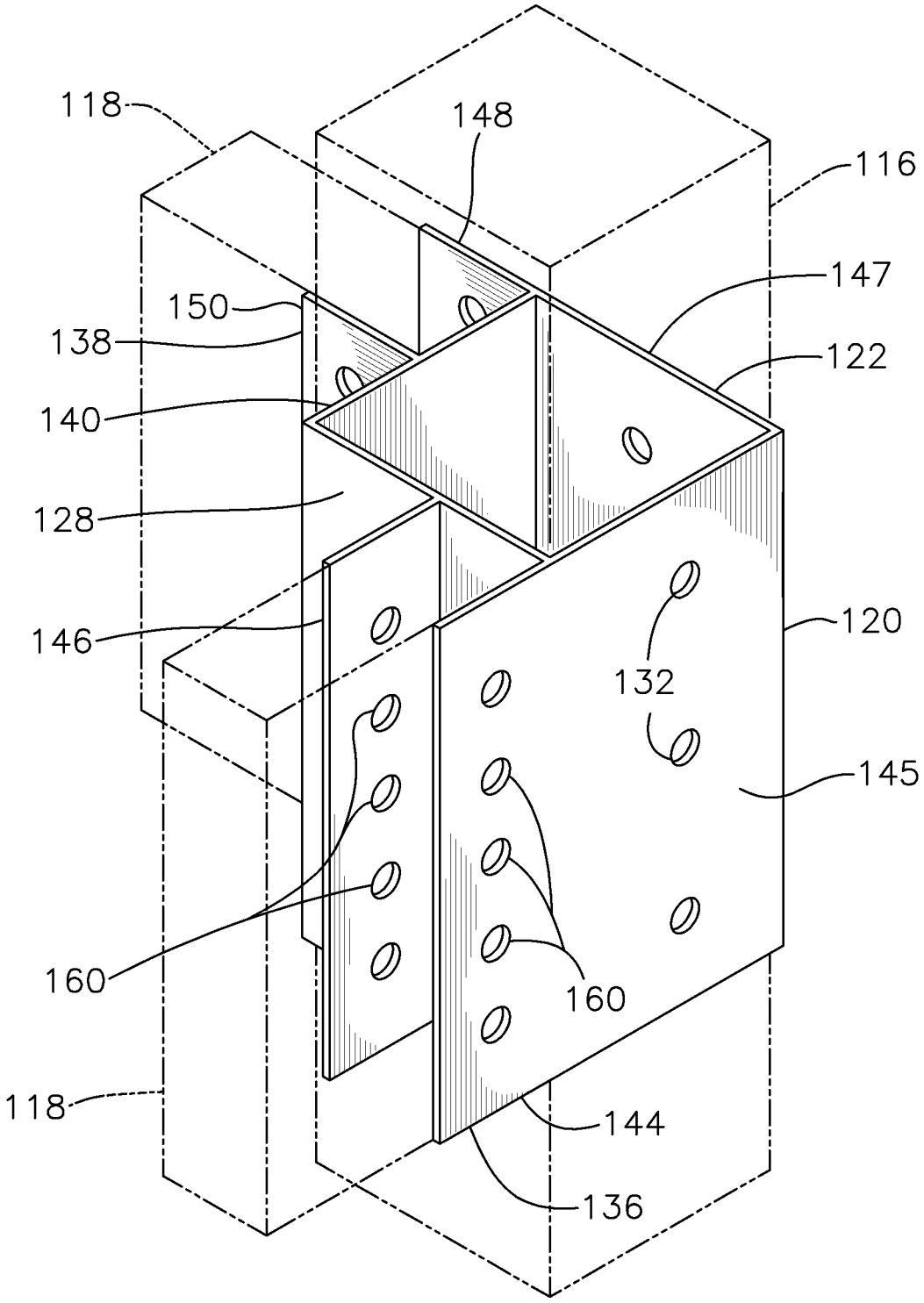
FIG. 6 is a perspective view of an alternative 90° beam support collar in accordance with this invention having a perpendicularly arranged pair of channels for supporting respective carrier beams.

FIG. 6-and 7 depict an alternative 90° beam supporting collar 120 in accordance with this invention, which is slidably and adjustably mounted on a respective upright post 116 of a screen enclosure or analogous structure. Collar 120 is composed and extruded or otherwise manufactured in a manner identical or analogous to that previously described. In particular, collar 120 includes a square or otherwise rectangular sleeve 122. Alternative configurations and sizes may be employed within the scope of this invention.

Figure 7:
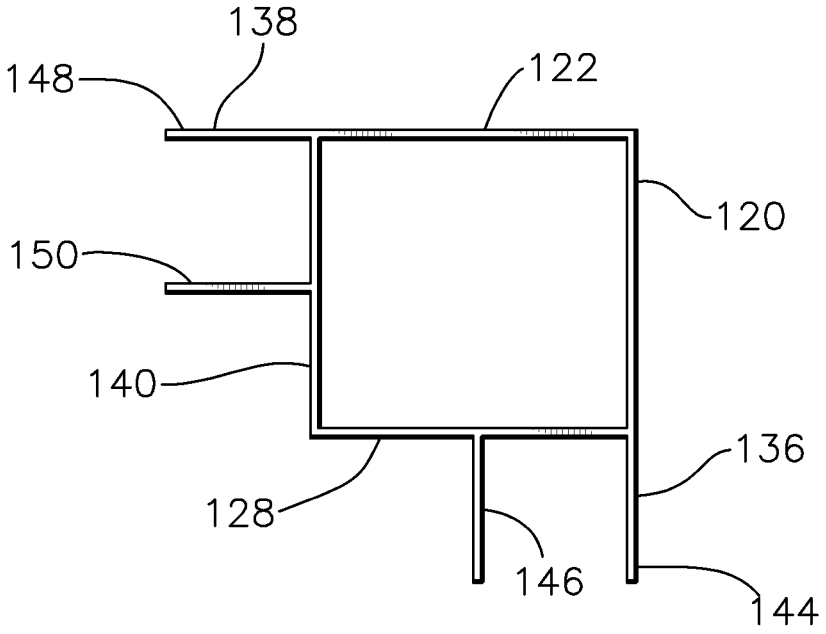
FIG. 7 is a top end view depicting the profile of the 90° beam support collar of FIG. 6.

A pair of beam supporting channels 136 and 138 are secured to and extend outwardly from adjacent exterior walls 128 and 140 of sleeve 122. The channels are again defined respectively by a pair of spaced apart and generally parallel flanges. Channel 136 includes a flange 144 that is coplanar and formed unitarily with a side wall 145 of sleeve 122. A second flange 146 extends outwardly from wall 128 of sleeve 122 to define channel 136. Analogously, channel 138 features a flange 148 that is integral and coplanar with wall 147 of sleeve 122. Channel 138 also includes a second flange 150 that extends outwardly from sleeve 140 and is generally parallel to flange 148. Each of channels 136 and 138 accommodates one end of respective carrier beam 118 such that beams 118 are formed substantially perpendicular to one another. As in the previously described embodiment, collar 120 is provided with a plurality of fastening holes 132 and 160. This enables collar 120 to be secured at a selected location along post 116 and further allows beams 118 to be secured to respective channels 136 and 138. In particular, collar 120 is selected such that its sleeve 122 has a shape and size that enable the collar to conformably receive upright post 116. The connectors 136 and 138 of collar 120 should similarly have a size and spacing for accommodating the carrier beams 118 to be supported. The desired height of the collar and supported beams is calculated and the collar is slid into a position corresponding to that height along post 116. Fastening screws or bolts as previously described, are engaged with respective fastening holes 132 and 160 such that the collar properly and securely interconnects the upright post and the carrier beams. Collar 120 shown in FIGS. 6 and 7 is typically used to mount beams 118 to a post 116 at a corner of the enclosure.

Figure 9:
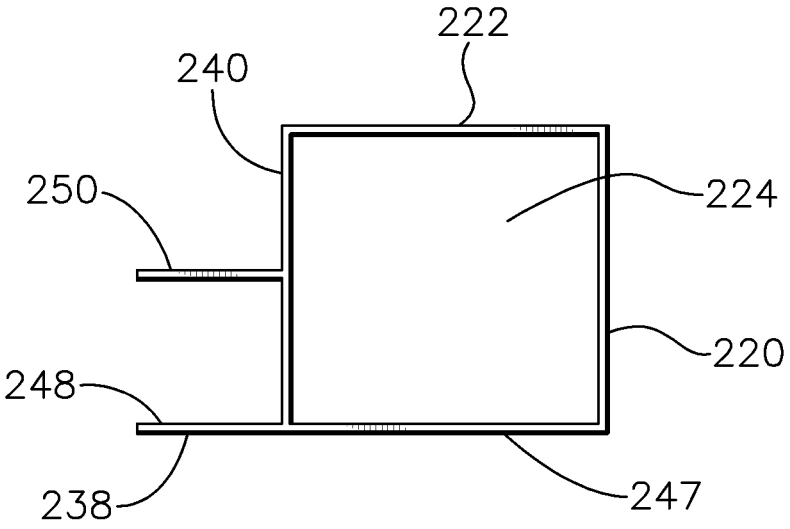
FIG. 9 is a top end view of the support collar of FIG. 8.
Figure 8:
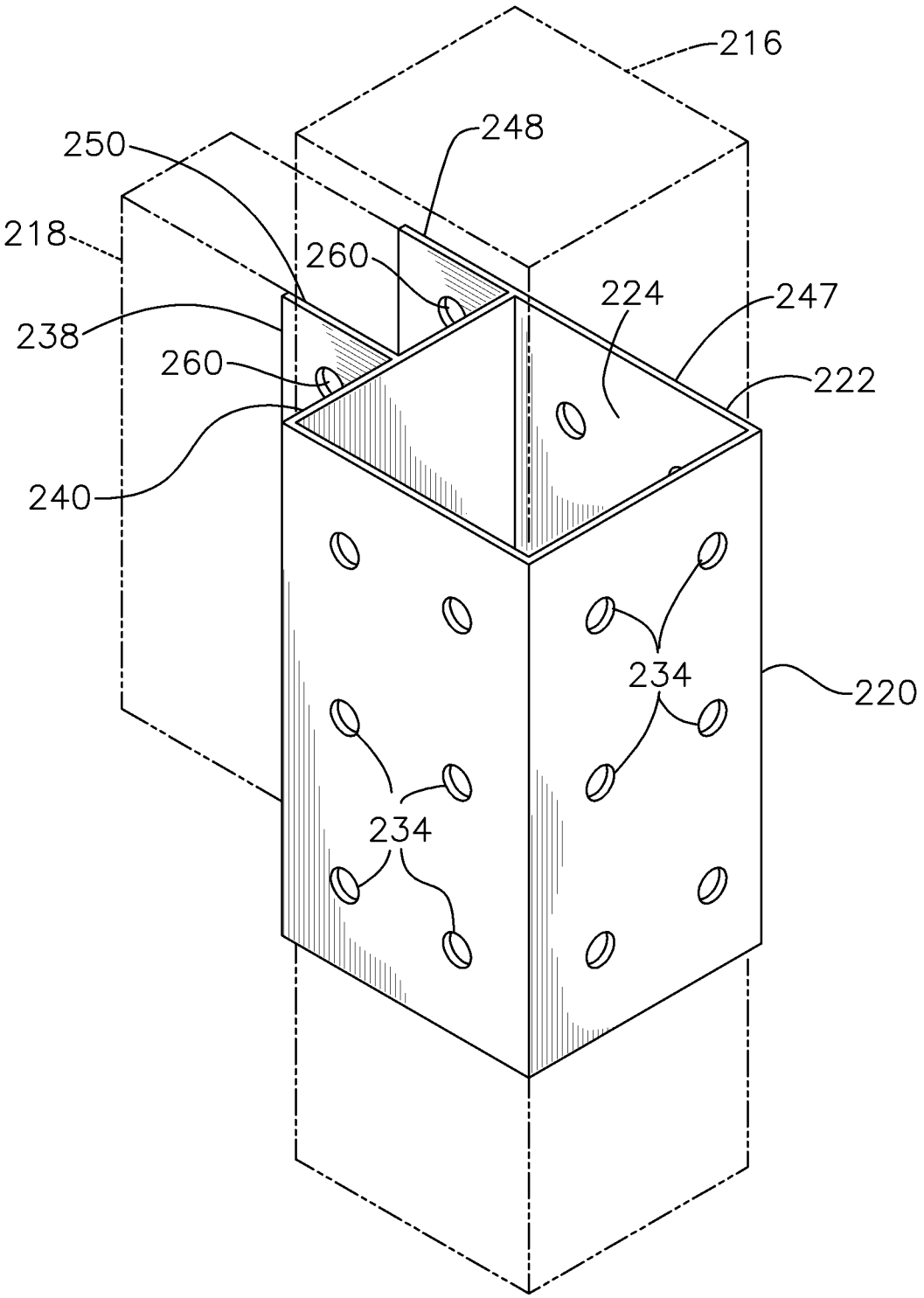
FIG. 8 is a perspective view of still another beam support collar in accordance with this invention featuring a single channel for supporting a carrier beam.

There is shown in FIGS. 8 and 9 another alternative collar 220 in accordance with this invention. Collar 220 may be composed and manufactured in a manner similar to that previously described. Once again, the collar includes a square or otherwise rectangular sleeve 222 having a central passageway 224 formed therethrough for slidably and conformably receiving an upright post 216 of a screen enclosure or analogous structure. Various numbers and arrangements of fastening holes 234 may be formed through respective walls of sleeve 222 for being engaged by appropriate fastening screws or other means to secure sleeve 222 and collar 220 at a desired position/height along post 216. As previously indicated, sleeve 222 and passageway 224 may have various sizes and alternative shapes. The number and configuration of the fastening holes may also be varied within the scope of this invention. In each embodiment, the sleeve and channel(s) may comprise a single extruded or otherwise unitary piece (preferred) or alternatively a multiple piece construction.

In the version of FIGS. 8 and 9, only a single channel 238 is featured. Once again, the channel comprises a pair of spaced apart and generally parallel flanges 248 and 250. Flange 248 is formed unitarily and coplanar with wall 247 and sleeve 222. Flange 250 extends unitarily from wall 240 of sleeve 222. The spacing between flanges 248 and 250 may vary.

In use, collar 220 is positioned along post 216 and secured by fastening screws or other means, which are engaged through holes 234 with the post 216 accommodated by passageway 224. One end of a beam 218 is then inserted between flanges 248 and 250 of connector 238 and fastening screws are engaged with beam 218 though the fastening holes 260 formed in the flanges of connector 238. Various alternative numbers and configurations of fastening holes and complementary fastening elements may be employed within the scope of this invention for both this and any of the versions disclosed herein.

Figure 10:
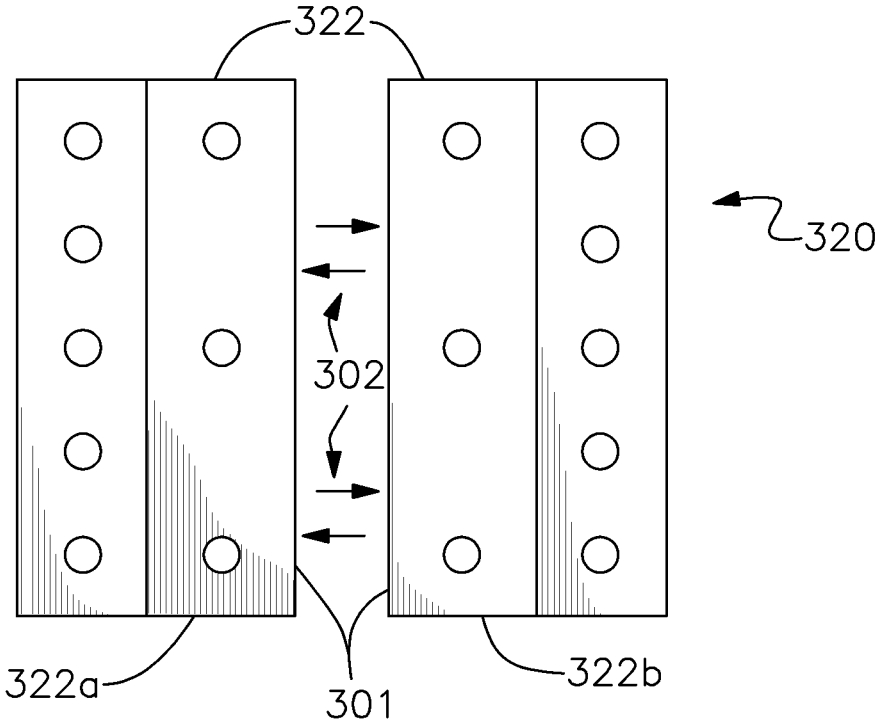
FIG. 10 is a front elevational view of an alternative 180° beam support collar featuring a split, multiple piece sleeve; each sleeve segment carries a respective channel and the sleeve segments are spatially adjustable to conformably engage upright posts having various sizes.
Figure 11:
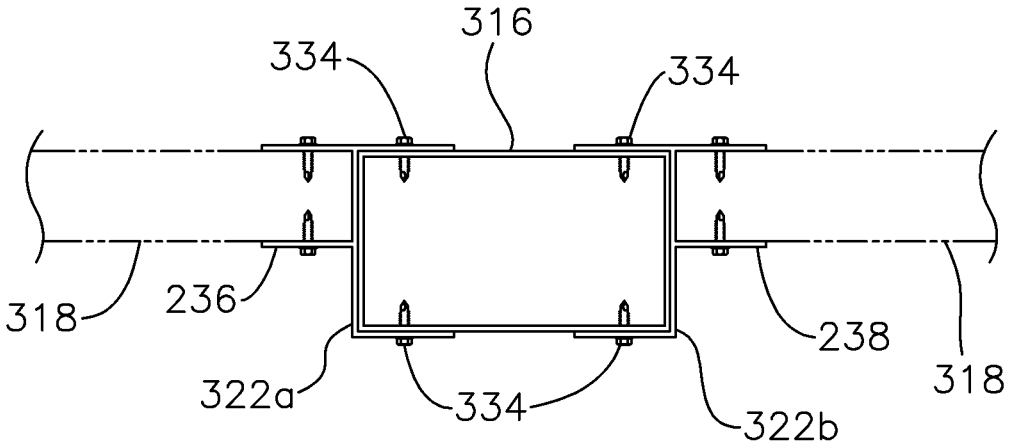
FIG. 11 is a fragmentary top plan view of the collar of FIG. 10 as attached to a non-square or oversized post and having a pair of channels that accommodate respective carrier beams.

An alternative collar construction that may be employed for any collar profile in accordance with this invention is shown in FIG. 10. Collar 320 includes a configuration that generally resembles the version shown in FIGS. 1-4 but is modified somewhat by employing a split sleeve. Each embodiment of this invention may be modified in an analogous manner. Collar 320 specifically comprises a sleeve 322 that is split and divided vertically at the midline 301 into a pair of discrete sleeve segments 322*a* and 322*b*. As a result, segments 322*a* and 322*b* are spatially adjustable relative to one another in the manner indicated by double-headed arrows 302. When segments 322*a* and 322*b* are interengaged along midline 301, collar 320 is configured identically to previously described collar 20. However, when segments 322*a* and 322*b* are disengaged and separated, this effectively increases the size of the passageway through the sleeve section. The two sleeve segments 322*a* and 322*b* may then be engaged, in the manner shown in FIG. 11, with a post 316 that is cross sectionally larger than the two contiguous sleeve segments but which has a peripheral cross sectional configuration that generally conforms to the interior configuration of the spaced apart sleeve segments. For example, in this version, the sleeve segments 322*a* and 322*b*, when interengaged with one another, may define a passageway very slightly greater than 4"×4". This will slidably accommodate a 4"×4" post, which allows the use of either collar 320 or a one piece collar as previously described in FIGS. 1-4. However, if the enclosure features 4"×6" or a 4"×8" post, as represented in FIG. 11, the discrete or split collar 320 allows the sleeve segments 322*a* and 322*b* to be spatially separated in the manner shown so that segment 322*a* conformably engages one side of post 316 and segment 322*b* similarly engages the opposite side of the post. Each of the collar segments is then secured to the post by four TEK screws or alternative fastening elements.

Each of sleeve segments 322*a* and 322*b* carries an integral or otherwise attached channel 236, 238 comprising a pair of spaced apart flanges, as previously described. After the discrete segments 322*a* and 322*b* of collar 320 are properly positioned along post 316 and secured in place, respective beams 318 are secured to channels 236 and 238 again in the manner previously described. Again, spatially adjustable sleeve segments, as described herein, may be used for any collar profile within the scope of this invention.

Additional alternative embodiments of the collar may be constructed in accordance with the scope of this invention. Various cross sectional configurations, profiles, sizes and dimensions may be employed. Moreover, the connectors may employ different shapes, depths, lengths and spacings. Various numbers of connectors may be utilized on a collar within the scope of this invention. Differing numbers of collars and various alternative collar constructions may be utilized for the screen enclosure or other structure being assembled. A typical beam will be supported at each end by a respective collar constructed according to the principles of this invention.

Figure 12:
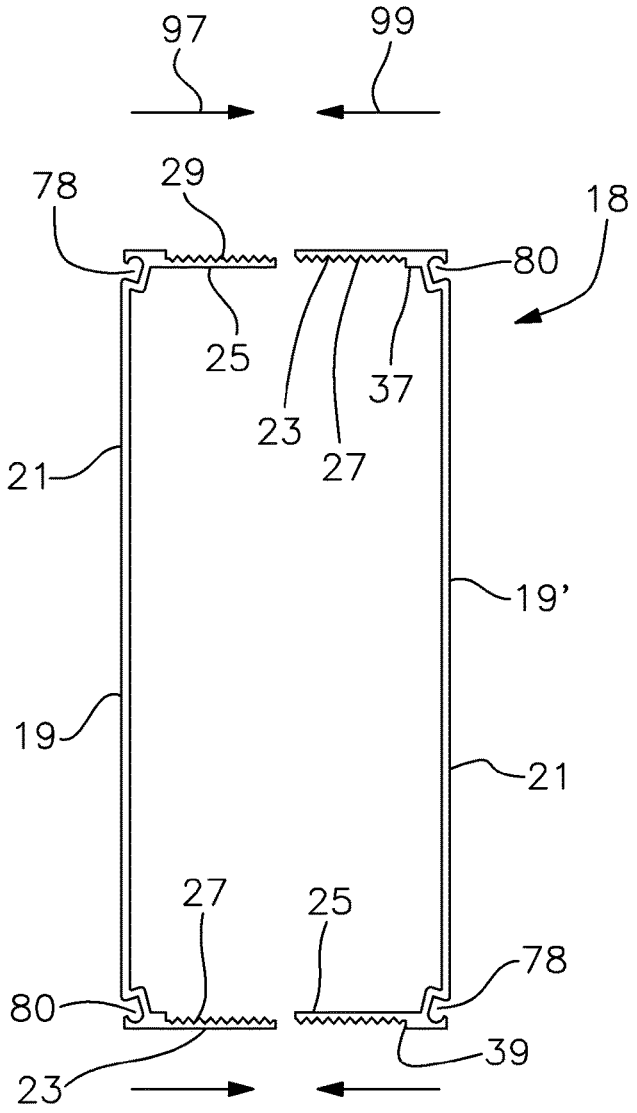
FIG. 12 is an elevational end view of a preferred support or carrier beam assembly as used in this invention and particularly illustrating how self-mating pieces of the beam are interengaged to provide for spline grooves formed in the broad faces of the beam.
Figure 13:
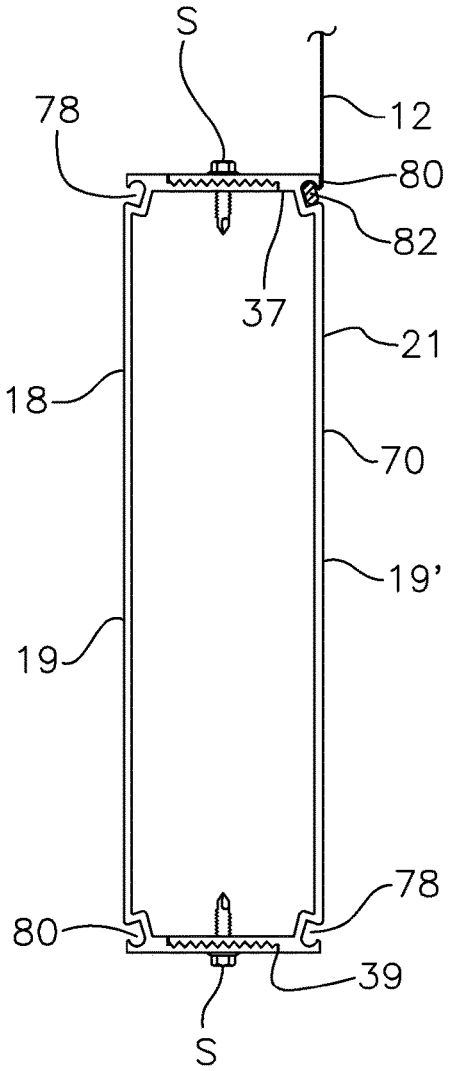
FIG. 13 is an elevational end view of the assembled carrier beam wherein the beam pieces are fastened together and a screen panel and elastomeric spline are engaged with and held by a spline groove in a wide face of the beam.

FIGS. 12 and 13 depict a particularly preferred construction for forming a box beam or carrier beam that includes a spline groove formed in the relatively wide front or back face of the beam. Conventionally, most extruded beams have formed the spline grooves in the relatively narrow top and/or bottom sides of the beam. Modifying such beams to position the spline groove on the broad outwardly facing (front) surface of the beam has previously required the use of a 1"×2" adapter piece, which adds considerable time, labor and expense to the screen enclosure assembly process. Such 1"×2" adapters are also very susceptible to failure especially in conditions where high winds are experienced.

The present invention overcomes the foregoing problems. In particular, beam 18, which should be understood as being representative of any of the structural beams described herein, comprises a pair of identical extruded beam pieces 19, 19' shown in FIG. 12. Each piece 19, 19' has an elongate, relatively wide face section 21 and a pair of elongate, relatively narrow leg sections 23 and 25, which are attached unitarily to and extend laterally from respective opposite longitudinal edges of face section 21. Leg 23 includes interiorly facing teeth 27 and leg 25 includes exteriorly facing teeth 29 that provide the respective leg sections with self-mating surfaces when the legs are interengaged as described below. The broad or wide face section 21 of each piece 19, 19' includes a pair of elongate spline grooves 80 that extend longitudinally through an exterior surface of the face section proximate respective longitudinal edges of the beam piece (see also FIG. 1). First leg section 23 further includes an interior rib 37 proximate face section 21 and adjacent one of the spline grooves 80. Leg 25 includes an exterior rib 39 at the inner end of the leg and adjacent the second spline groove.

Each beam piece 19, 19' is constructed in the foregoing manner. Nonetheless, it should be understood that in alternative embodiments, the extruded beam piece may include only a single spline groove in its face section. Also, a spline groove may be formed in at least one of the leg sections.

Extruded beam pieces 19, 19' may be interengaged in the manner shown in FIGS. 12 and 13 to form the assembled beam 18 of this invention. In particular, the two beam pieces are oriented at shown in FIG. 12, with leg 25 of the first beam piece 19 juxtaposed against leg 23 of the second beam piece 19' and leg 23 of the first beam piece 19 juxtaposed against leg 25 of the second beam piece 19'. The two beam pieces are pressed together, as indicated by arrows 97 and 99. As a result, the respective legs interengage and the opposing teeth provide for a self-mating interengagement between leg 23 of the first piece 19 and leg 25 of the second piece 19', and likewise between leg 25 of first piece 19 and leg 23 of the second piece 19'.

As shown in FIG. 13, extruded pieces 19, 19' are interengaged and fastening screws S are inserted through the self-mating legs, this defines a carrier or box beam 18. Spline grooves 80 thereby extend longitudinally along each of the upper and lower longitudinal edges of both the front and back faces of the assembled beam. In FIG. 13, the right hand face section 21 of beam piece 19' effectively forms the outwardly facing or front surface 70 of beam 18. See FIG. 1. As shown, a spline element 82 is inserted into at least one of spline grooves 80 and engaged with an edge of a screen panel 12 to secure that panel to the framework of the screen enclosure.

The positioning of the spline groove 80 and accommodated spline element 82 holds the edge of the screen panel 12 in place much more effectively than in structures wherein the spline groove and spline are positioned on the top narrow side of the beam. Large picture window screen panels are thereby much better able to resist high winds and adverse weather conditions without the screen being disrupted or torn away from the frame. In addition, the present invention eliminates the need to employ 1"×2' attachments pieces in order to form a spline groove on the wide front face of the beam, as well as the problems associated with that previously attempted solution.

The support assembly of the present invention significantly and efficiently facilitates the construction process by significantly reducing the time, labor and expense normally involved with installing screen enclosures and particularly large multi-story screen enclosures. The collar may be quickly and easily positioned and mounted in place along the column or post to reliably support beams at required heights without requiring the tedious, time consuming and often imprecise measurements and post cutting required by the prior art. Moreover, the wasted time, labor, materials and expense that commonly result from incorrectly measuring, cutting and/or otherwise installing extruded components in screen enclosures are greatly reduced. Even inexperienced workers are able to more successfully and expeditiously install structural beams and other framework components of an extruded screen enclosure by using the support assembly of this invention. The system is versatile and effective for use with extruded framework components having assorted sizes and configurations.

From the foregoing it may be seen that the apparatus of this invention provides for a screen enclosure support assembly featuring a novel beam support collar and a structural beam construction featuring, a spline groove in the wide face of the beam. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. An extruded beam piece for use in a box beam of a screen enclosure, which box beam is supported by a vertically upright post such that the beam extends horizontally from the post for supporting at least one screen panel to extend from the beam in a substantially vertically planar orientation, said extruded beam piece consisting of:

an elongate, relatively wide vertical face section and a pair of elongate, relatively narrow horizontal leg sections that are attached unitarily to and extend laterally and inwardly from respective longitudinal edges of said face section, said leg sections terminating at respective distal ends to form a void, which separates said distal ends of said leg sections, said face section having a pair of exterior spline grooves extending longitudinally therethrough, each said spline groove proximate a said respective longitudinal edge thereof, said spline grooves being formed by respective recessed portions of said relatively wide face section to interrupt an otherwise substantially planar exterior surface of said face section, which otherwise substantially planar exterior surface of said face section extends fully across the width of said face section between said respective longitudinal edges of said face section, each said leg section consisting of a substantially flat first side and an opposite second side unitarily joined to said first side and carrying a series of longitudinal teeth and a longitudinal rib interposed between said series of longitudinal teeth and a respective said recessed portion of said face section, each said exterior spline groove for receiving a horizontal edge of a respective screen panel and a complementary spline component to secure the respective screen panel to the beam piece and hold the respective screen panel such that the respective screen panel extends from the beam piece in the substantially vertically planar orientation.

2. The beam piece of claim 1 in which said exterior spline groove includes an entrance formed in said exterior surface of said face section, said entrance facing outwardly from said exterior surface in a direction substantially perpendicular to the plane of said exterior surface, said exterior spline groove for receiving a horizontal edge of a respective screen panel and complementary spline component to secure the respective screen panel to said beam piece such that the a screen panel is extendable vertically from a respective said longitudinal edge of and substantially coplanar with said exterior surface of said face section.

3. A two-piece, self-mating structural beam assembly for being supported by and extending horizontally from a vertically upright post of a screen enclosure to hold a horizontal edge of a screen panel such that the screen panel is held to extend from the beam in a substantially vertical orientation, said assembly comprising:

separate and discrete first and second elongate self-mating beam pieces, each said beam piece including an elongate, relatively wide vertical face section and a pair of elongate, relatively narrow horizontal leg sections extending laterally from respective opposite longitudinal edges of said face section to define a pair of longitudinal corners of said beam piece, each said leg of said first beam piece consisting of a substantially flat first side and an opposite second side unitarily joined to said first side and carrying a first series of longitudinal teeth and a longitudinal rib interposed between said series of longitudinal teeth and said vertical face section, each said leg of said second beam piece including a substantially flat first side and a second side that carries a second series of teeth and a second rib interposed between said second series of teeth and said vertical face section of said second beam piece, said respective pairs of leg sections of said first and second beam pieces being interengaged and interconnected to form a generally rectangular beam having an elongate interior chamber extending longitudinally therethrough and wherein said relatively wide vertical face sections of said first and second beam pieces respectively oppose and are generally parallel to one another, said relatively wide vertical face section of said first beam piece having a pair of exterior spline grooves extending longitudinally therethrough and proximate respective longitudinal edges of said vertical face section, said exterior spline grooves being formed by respective recessed portions of said vertical face section in an otherwise planar exterior surface of said vertical face section between said respective longitudinal edges of said vertical face section, each said exterior spline groove including an entrance formed in said exterior surface of said vertical face section, said entrance facing outwardly from said exterior surface in a direction substantially perpendicular to the plane of said exterior surface, each said exterior spline groove for receiving a horizontal edge of a respective screen panel and a complementary spline component to secure the screen panel to said beam assembly such that the screen panel extends vertically from said respective longitudinal edge of said vertical face section of said first beam piece and is substantially coplanar with said exterior surface of said vertical face section; said second beam piece including at least one interior spline groove extending longitudinally therethrough and proximate a respective said longitudinal corner of said second beam piece; said first and second beam pieces being interconnected by a fastener.

4. The beam of claim 3 in which said fastener includes an elongate element that extends through said interengaged leg sections of said first and second beam pieces and through said interior chamber of said beam to beyond a respective one of said recessed portions of said vertical face.

5. The assembly of claim 3 in which said first beam piece includes a first leg section of said pair of leg sections that has an orthogonally shaped interior rib formed on an inside surface thereof contiguous with a first respective said recessed portion of said face section, said first beam piece further including a second leg section of said pair of leg sections that has an orthogonally shaped exterior rib formed on an outside surface thereof contiguous with a second respective said recessed portion of said face section, whereby when said respective pairs of leg sections are interengaged and interconnected, and said first and second leg sections of said second beam piece interengage said exterior and interior ribs respectively of said first beam piece.

6. The assembly of claim 5 which said pair of leg sections include respective self-mating surfaces facing the same direction such that interengaging said first and second leg sections of said first beam piece with said second and first leg sections respectively of said second beam piece attaches said first and second beam pieces together.

7. The assembly of claim 6 in which one of said pair of leg sections of each said beam piece interengages and interconnects to the other of said pair of leg sections of the other said beam piece to form said beam assembly.

8. The assembly of claim 6 in which said self-mating surfaces include gripping teeth that cooperate when said respective leg sections of said first and second beam piece are interengaged to secure said first beam piece to said second beam pieces and form said beam assembly.

9. The assembly of claim 3 in which said first and second beam pieces are identical.

10. The assembly of claim 3 in which said exterior spline groove and said entrance of said spline groove are configured for receiving the screen panel and complementary spline component such that said screen panel is wrappable around said entrance of said spline groove and extendable vertically across and substantially coplanar with said exterior surface of said vertical face section.

11. An extruded beam piece for use in a box beam of a screen enclosure, which box beam is supported by a vertically upright post such that the beam extends horizontally from the post for supporting a screen panel to extend from the beam in a substantially vertically planar orientation, said extruded beam piece comprising:

an elongate, relatively wide vertical face section and a pair of elongate, relatively narrow horizontal leg sections that are attached unitarily to and extend laterally and inwardly from respective longitudinal edges of said face section, each said leg section consisting of a substantially flat first side and an opposite second side unitarily joined to said substantially flat first side and carrying a series of longitudinal teeth and a longitudinal rib interposed between said series of longitudinal teeth and said face section, said leg sections, terminating at respective distal ends to form a void, which separates said distal ends of said leg sections, said face section having an exterior spline groove extending longitudinally therethrough, and proximate a respective said longitudinal edge thereof, said exterior spline groove being formed by a recessed portion of said face section for receiving a horizontal edge of a screen panel and a complementary spline component to secure the screen panel to the beam piece and hold a horizontal edge of the screen panel such that the screen panel extends from the beam piece in the substantially vertically planar orientation.

* * * * *